US006101905A

United States Patent [19]

Hu

[11] Patent Number: 6,101,905

[45] Date of Patent: Aug. 15, 2000

[54] HOOK SCREW DRIVERS

[76] Inventor: Bobby Hu, No. 6, Alley 235, Lane 75, Section 3, Kang Ning Road, Nei Hu District, Taipei, Taiwan

[21] Appl. No.: 09/126,538

[22] Filed: Jul. 30, 1998

[51] Int. Cl.[7] ..... B25B 13/02

[52] U.S. Cl. ..... 81/125; 81/901

[58] Field of Search ..... 81/129, 177.1, 81/489, 491, 901, 487, 44, 125

[56] References Cited

U.S. PATENT DOCUMENTS

| | | | |
|---|---|---|---|
| 670,361 | 3/1901 | Sather | 81/901 |
| 693,406 | 2/1902 | Kydd | 81/901 |
| 841,472 | 1/1907 | Vanderherchen | 81/901 |
| 1,980,087 | 11/1934 | Rast | 81/489 |
| 2,642,105 | 6/1953 | Alliano | 81/901 |
| 5,058,465 | 10/1991 | Womack | 81/487 |
| 5,335,569 | 8/1994 | Rowley | 81/901 |

FOREIGN PATENT DOCUMENTS

| | | | |
|---|---|---|---|
| 12045 | of 1914 | United Kingdom | 81/901 |

*Primary Examiner*—David A. Scherbel
*Assistant Examiner*—Joni B. Danganan
*Attorney, Agent, or Firm*—Charles E. Baxley

[57] ABSTRACT

A hook screw driver includes a main body including at least one compartment defined therein. A disc is slidably, removably received in the compartment. The disc has a retaining section with a pattern formed thereon, the pattern being constructed by a number of spaced blocks that constitute a plurality of grooves adapted to securely retain a hook portion of a hook screw. The retaining section of the disc is movable between a first position outside the main body for receiving the hook portion of the hook screw and a second position in the compartment of the main body for retaining the hook portion of the hook screw in position.

19 Claims, 8 Drawing Sheets

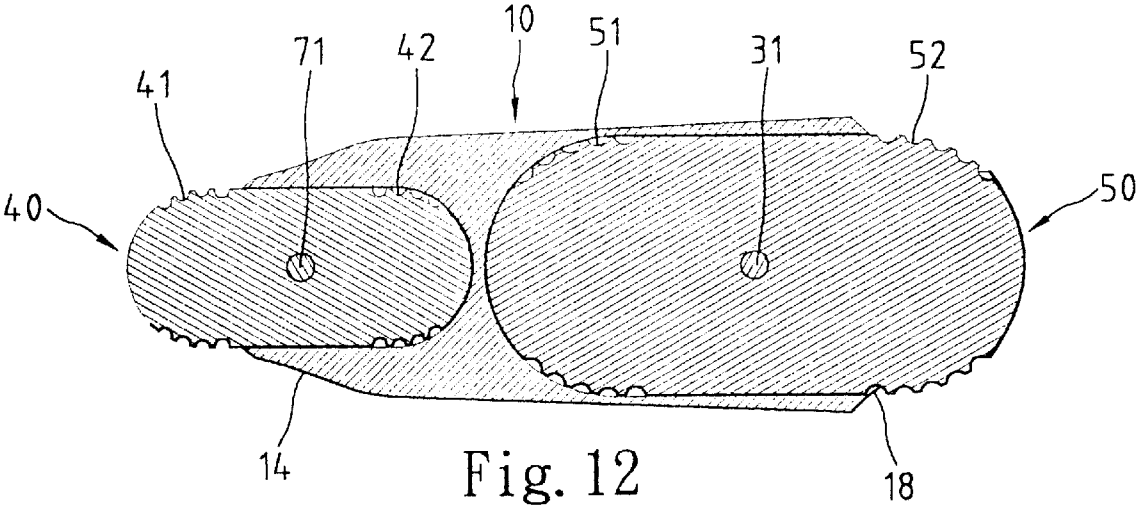
Fig. 12
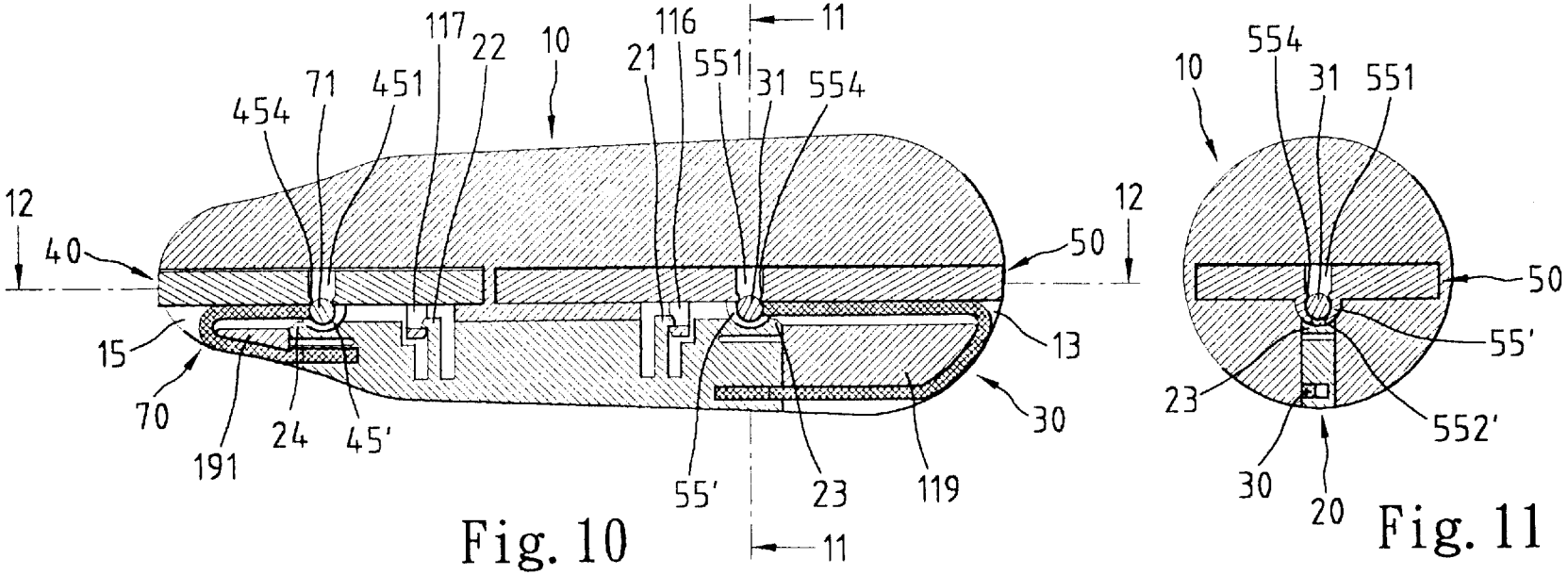
Fig. 10
Fig. 11

HOOK SCREW DRIVERS

BACKGROUND OF THE INVENTION

1. Field of the Invention

The present invention relates to hook screw drivers that may be applied to hook screws of various sizes.

2. Description of the Related Art

Hook screws are widely used on wooden walls for hanging objects. The user often use a pair of pliers to clamp a hook screw when mounting the hook screw to a wooden wall, which is inconvenient and may cause damage to the hook screw. Although devices have been proposed to securely hold hook screws, yet the holding effect is found unsatisfactory. In addition, the conventional devices cannot be applied to hook screws of various sizes as there are many shapes and sizes in the hook portion of the hook screw. The present invention is intended to provide improved hook screw drivers to solve these problems.

SUMMARY OF THE INVENTION

It is a primary object of the present invention to provide an improved hook screw driver that can be applied to securely hold hook screws of various sizes so as to mount the hook screws to a wooden wall.

A hook screw driver in accordance with the present invention comprises a main body including at least one compartment defined therein. A disc is slidably, removably received in said at least one compartment. The disc has a retaining section with a pattern formed thereon. the pattern being constructed by a plurality of spaced blocks that constitute a plurality of grooves adapted to securely retain a hook portion of a hook screw. The retaining section of the disc is movable between a first position outside the main body for receiving the hook portion of the hook screw and a second position in the compartment of the main body for retaining the hook portion of the hook screw in position.

The disc may further include a second retaining section formed thereon and having a second pattern other than the first-mentioned pattern and constructed by a plurality of spaced second blocks that constitute a plurality of second grooves to provide more selection so as to hold the hook portions of the hook screws of different sizes.

The main body may include a retaining means provided thereon. A string may be provided and has a first end securely attached to the disc and a second end securely attached to the retaining means.

In an embodiment of the invention, the disc includes a recess defined in an upper side thereof, and the first end of the string includes a ball securely attached thereto and received in the recess of the disc. The disc includes a guiding pin mounted to the underside thereof, while the main body includes a track defined in an underside thereof and communicated with said at least one compartment. The guiding pin is slidable along the track. In addition, the main body includes a hole defined in an underside thereof and communicated with the track and the compartment, and the retaining means is securely received in the hole. The hole is communicated with the track via a neck to retain the guiding pin of the disc in the hole when the retaining section of the disc is in the second position, and the guiding pin is forcibly passable through the neck.

In an alternative embodiment of the invention, the retaining means includes at least one hook fastener, and the main body includes a member for engaging with said at least one hook fastener. The disc includes a guiding pin mounted to the underside thereof, while the main body includes a track defined in an underside thereof and communicated with said at least one compartment. The guiding pin is slidable along the track. The retaining means includes a stop formed on an end thereof, and the stop includes a recessed section to retain the guiding pin in position. The disc includes a recess defined in an upper side thereof, in which a periphery defining the recess includes two protrusions formed thereon. The first end of the string includes a ball securely attached thereto and received in the guiding pin via the recess of the disc. The guiding pin further includes a slot that communicates with the underside of the disc so as to allow the second end of the string to pass through the slot to the retaining means. The retaining means may include a receiving receptacle to securely receive the second end of the string.

In a preferred embodiment of the invention, a hook screw driver comprises a main body including two compartments respectively defined in two ends thereof, and a first disc and a second are slidably, removably received in the compartments, respectively. The first disc has a first retaining section and a second retaining section formed on an upper side thereof, while the second disc has a third retaining section and a fourth retaining section formed on an upper side thereof. The first retaining section, the second retaining section, the third retaining section, and the fourth retaining section respectively have a first pattern, a second pattern, a third pattern, and a fourth pattern formed thereon and different from one another. Each of the first pattern, the second pattern, the third pattern, and, the fourth pattern is constructed by a plurality of spaced blocks that constitute a plurality of grooves adapted to securely retain a hook portion of a hook screw. In addition, each of the first retaining section, the second retaining section, the third retaining section, and the fourth retaining section is movable between a first position outside the main body for receiving the hook portion of the hook screw and a second position in an associated compartment for retaining the hook portion of the hook screw in position.

Other objects, advantages, and novel features of the invention will become more apparent from the following detailed description when taken in conjunction with the accompanying drawings.

BRIEF DESCRIPTION OF THE DRAWINGS

FIG. 10 is a longitudinal, vertical section of the second embodiment of the hook screw driver;

FIG. 11 is a sectional view taken along line 11—11 in FIG. 10;

FIG. 12 is a sectional view taken along line 12—12 in FIG. 10; and

DETAILED DESCRIPTION OF THE PREFERRED EMBODIMENTS

Figure 1:
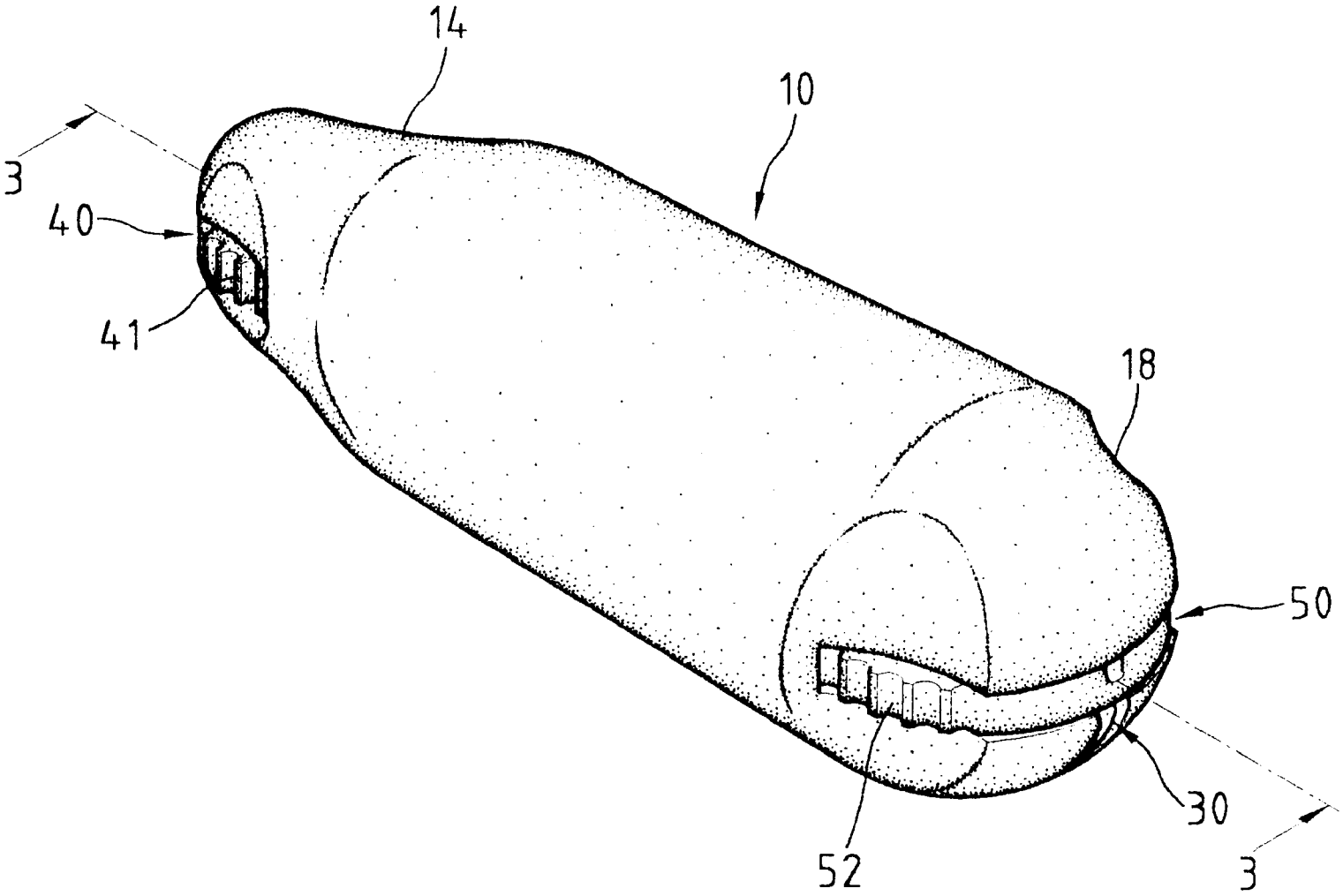
FIG. 1 is a perspective view of a first embodiment of a hook screw driver in accordance with the present invention.
Figure 2:
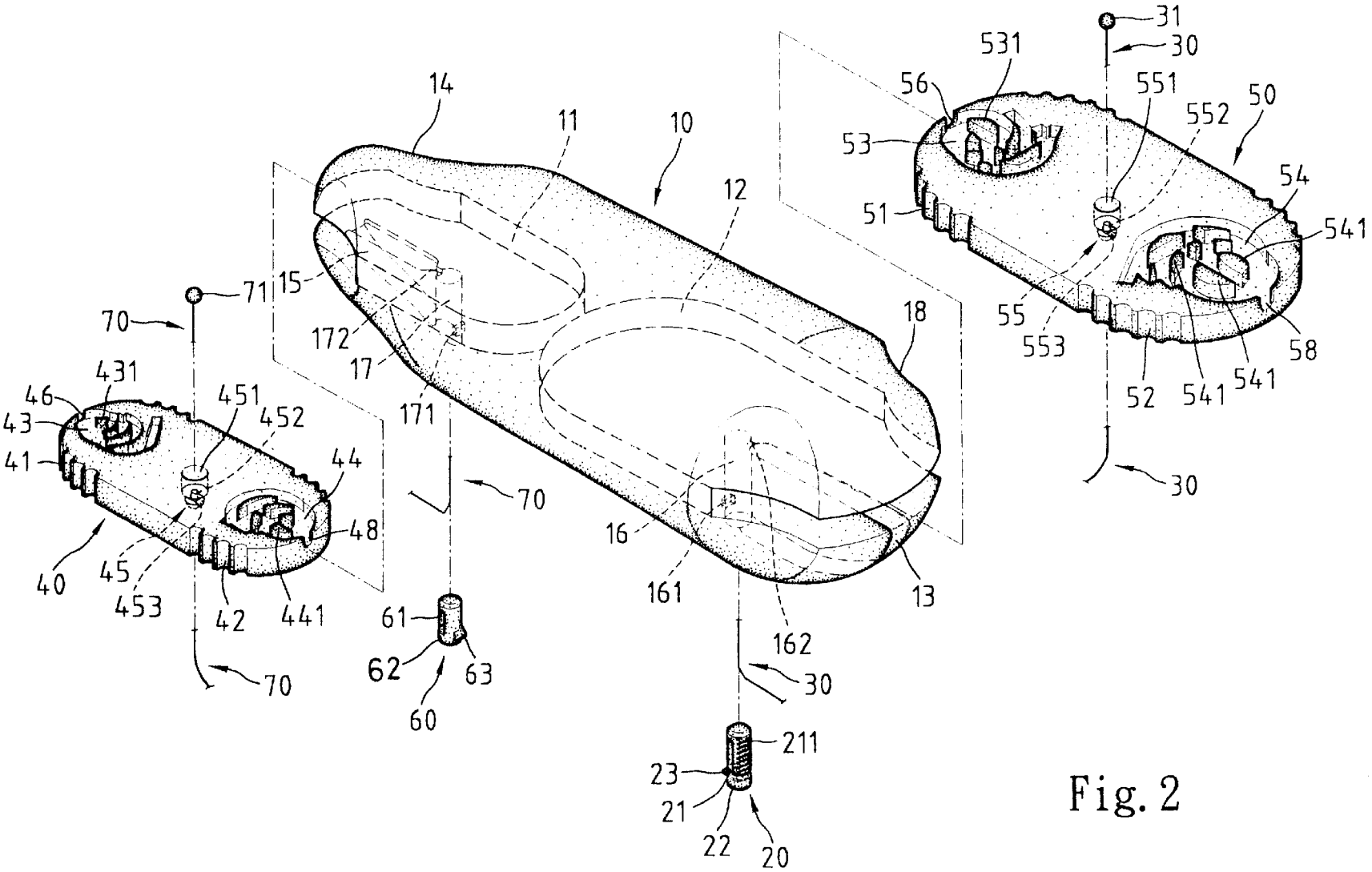
FIG. 2 is an exploded perspective view of the first embodiment of the hook screw driver.

Referring to the drawings and initially to FIGS. 1 and 2, a first embodiment of a hook screw driver in accordance with the present invention generally includes a main body 10 having a first compartment 11 and a second compartment 12 respectively defined in two ends thereof. As shown in FIG. 2, the main body 10 further includes a first track 15 and a second track 13 defined in an underside thereof and respectively communicated with the first compartment 11 and the second compartment 12. The underside of the main body 10 further includes a first vertical hole 17 and a second vertical hole 16 respectively communicated with the first compartment 11 and the second compartment 12 and also respectively communicated with the first track 15 and the second track 13 via a first neck 172 and a second neck 162. respectively. An inner periphery that defines the first vertical hole 17 includes a retaining groove 171 defined therein, while an inner periphery that defines the second vertical hole 16 also includes a retaining groove 161 defined therein.

Figure 4:
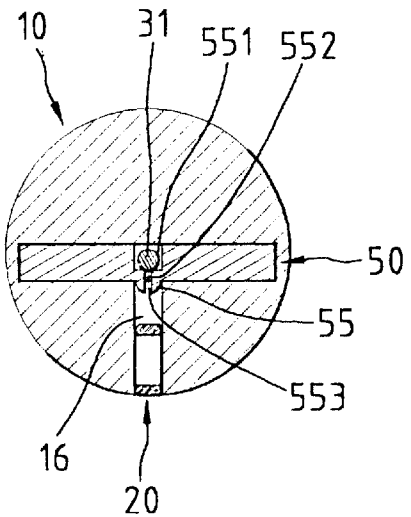
FIG. 4 is a sectional view taken along line 4—4 in FIG. 3.
Figure 3:
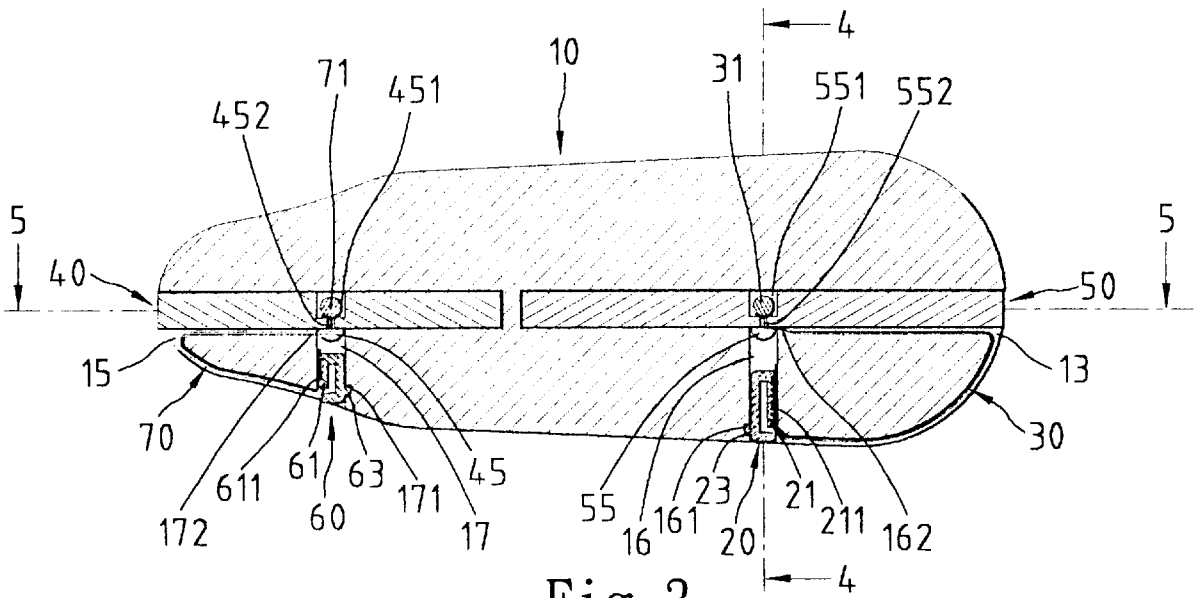
FIG. 3 is a sectional view taken along line 3—3 in FIG. 1.

A first disc 40 and a second disc 50 are slidably, removably mounted in the first compartment 11 and the second compartment 12, respectively. Referring to FIGS. 2 and 3, the first disc 40 includes a guiding pin 45 formed on an underside thereof and slidable along the first track 15. The first disc 40 further includes a recess 451 defined in an upper side thereof and communicated with the underside of the first disc 40 via a channel 452. In this embodiment, the guiding pin 45 includes a slit 453 defined therein, and the channel 452 is communicated with the slit 453. Similarly, the second disc 50 includes a guiding pin 55 formed on an underside thereof and slidable along the second track 13. The second disc 50 further includes a recess 551 defined in an upper side thereof and communicated with the underside of the second disc 50 via a channel 552. In this embodiment, the guiding pin 55 includes a slit 553 defined therein, and the channel 552 is communicated with the slit 553 (FIG. 4).

Figure 7:
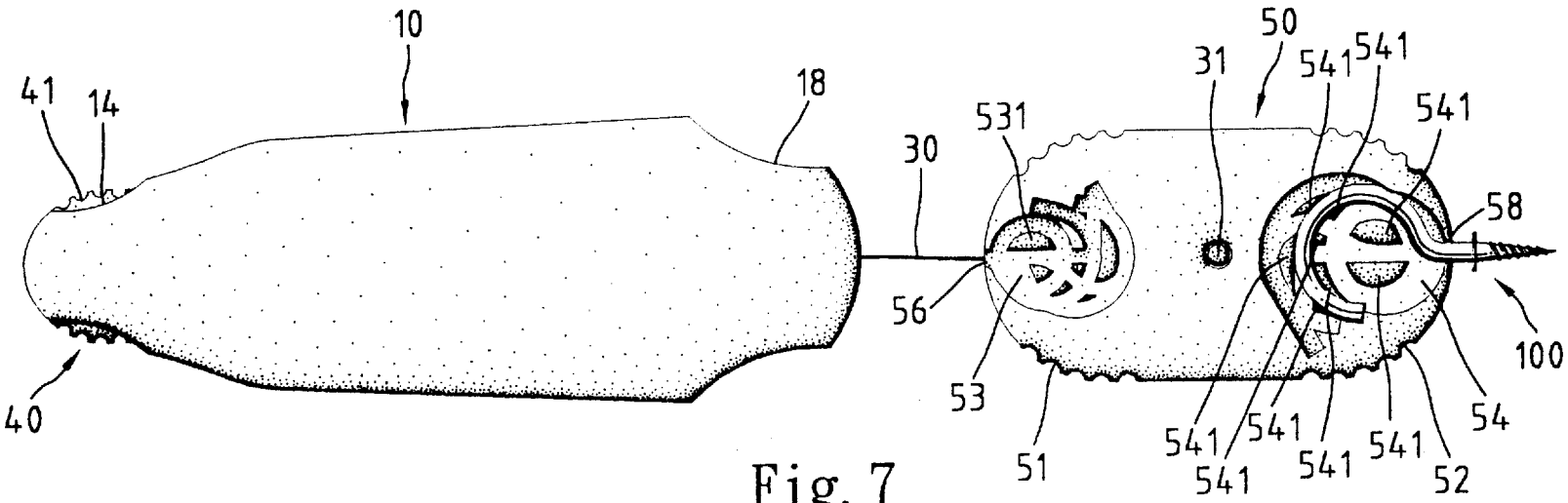
FIGS. 7 and 8 are schematic top views illustrating operation of the hook screw driver.

In addition, the first disc 40 includes a first retaining section 43 and a second retaining section 44 formed on an upper side thereof, while the second disc 50 includes a third retaining section 53 and a fourth retaining section 54 formed on an upper side thereof. The first retaining section 43, the second retaining section 44, the third retaining section 53, and the fourth retaining section 54 respectively have a first pattern, a second pattern, a third pattern, and a fourth pattern formed thereon and different from one another. Each of the first pattern, the second pattern, the third pattern, and the fourth pattern is constructed by a plurality of spaced blocks 431, 441, 531, 541 that constitute a plurality of grooves adapted to securely retain a hook portion of a hook screw 100 (FIG. 7) the size of which may vary in a wide range. It is appreciated that each pattern is a combination of several pattern elements such that the hook screw driver of the present invention may be applied to hook screws of numerous sizes as each of the first, second, third, and fourth retaining sections 43, 44, 53, and 53 may be applied to hook screws of various sizes in different ranges. Each disc 40, 50 includes two notches 46 and 48; 56 and 58 formed on two ends thereof which allow a stem portion of the hook screw 100 to extend therethrough (FIG. 7). Each end of the first disc 40 may include a grasp section 41, 42 formed on an outer periphery thereof to allow easy grasp. Similarly, the second end of second disc 50 may include a grasp section 51, 52 formed on an outer periphery thereof to allow easy grasp.

Each hole 17, 16 receives a retaining plug 60, 20 therein. As shown in FIG. 2, each retaining plug 60, 20 includes a key 63, 23 formed on an outer periphery of a lower end 62, 22 thereof for engaging with an associated retaining groove 171, 161. Each retaining plug 60, 20 further includes a retaining section 61, 21 having a number of retaining teeth 611, 211. Two strings 70, 30 are provided and each include a first end with a ball 71, 31 securely attached thereto and a second end.

Figure 5:
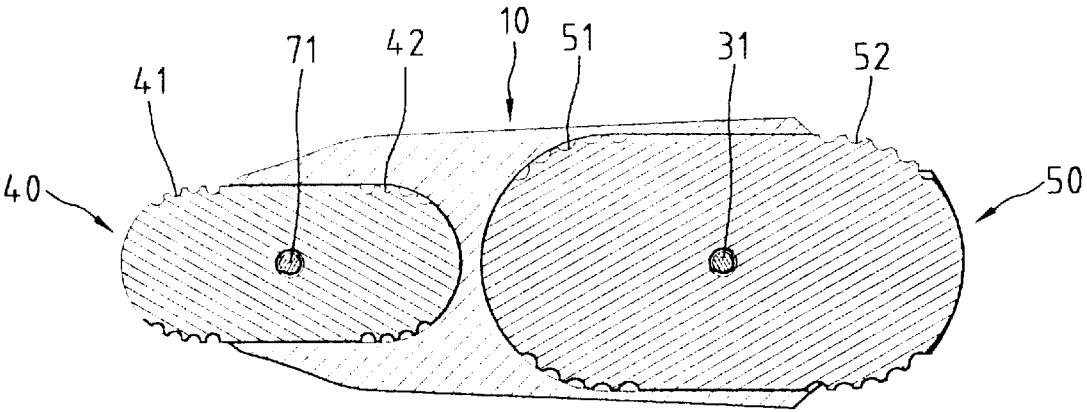
FIG. 5 is a sectional view taken along line 5—5 in FIG. 3.
Figure 6:
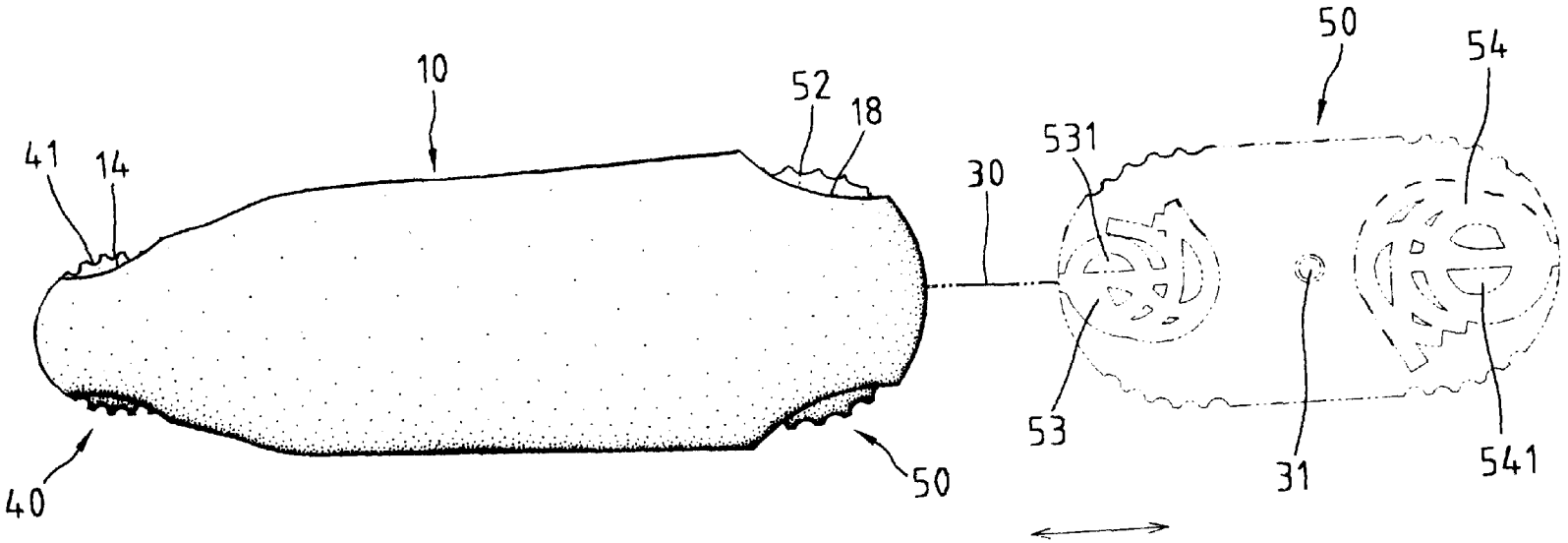
FIG. 6 is a top view of the hook screw driver.

In assembly, the ball 71, 31 on each string 70, 30 is received in the recess 451, 551 of the associated disc 40, 50 (FIGS. 3 and 5). Each string 70, 30 is then extended through the channel 452, 552 with the second end thereof securely attached to the retaining section 61, 21 of the associated retaining plug 60, 20 which is securely received in the associated hole 17, 16, best shown in FIG. 3. Each disc 40, 50 is slid into the associated compartment 11, 12 via the associated track 15, 13. The guiding pin 45, 55 of the disc 40, 50 may be forcibly passed through the associated neck 172, 162 (FIG. 2) and entered into the associated hole 17, 16 to retain the disc 40, 50 in position. This is because the guiding pin 45, 55 is made of resilient material and includes a slit 453, 553 (FIG. 4). It is appreciated that each disc 40, 50 may be removed from the associated compartment 11, 12 by forcibly passing the guiding pin 45, 55 through the associated neck 172, 162 and moving the disc 40, 50 outwardly along the associated track 15, 13. However, as shown by phantom lines in FIG. 6, the disc 40, 50 is still attached to the retaining plug 60, 20 via the string 70, 30 to thereby prevent from inadvertent loss of the disc 40, 50.

Figure 8:
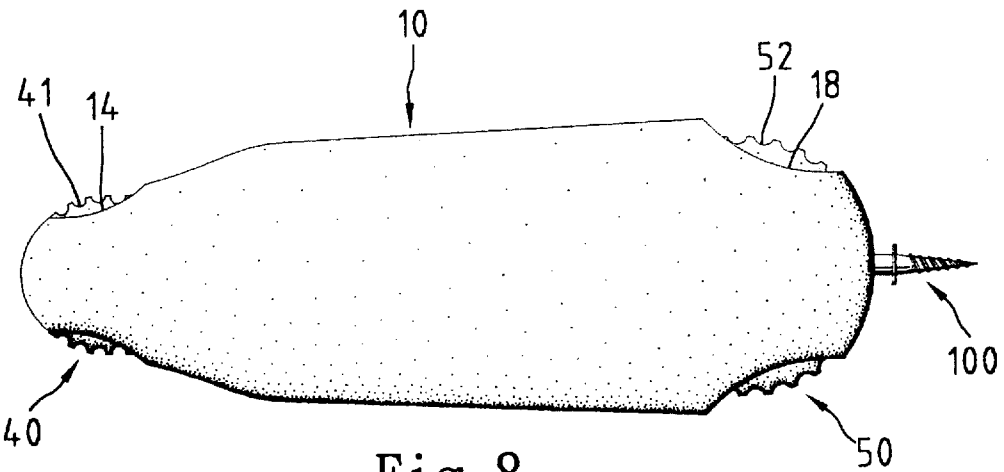

In use, the user may grasp e.g., the grasp section 51 of the second disc 50 and pull the second disc 50 outwardly to a status shown in FIG. 7. The hook portion of a hook screw 100 may be fittingly received in the retaining section 541 with a stem thereof extended beyond the second disc 50 via the notch 58. The second disc 50 is re-inserted into the second compartment 12 of the main body 10 along the track 13, as shown in FIG. 8. It is appreciated that the guiding pin 55 of the second disc 50 is forcibly passed through the neck 162 (FIG. 2) and entered the hole 16 to retain the second disc 50 in position. As a result, the hook screw 100 is securely held at its hook portion by the hook screw driver and thus can be threaded into a wooden wall upon manual rotational operation on the hook screw driver. After completion of mounting the hook screw onto the wooden wall, the user may pull the main body 10 to separate the main body 10 from the second disc 50. More specifically, the hook screw driver will be in a status shown in FIG. 7 again as the hook screw 100 is now securely attached to the wooden wall (not shown). Thus, the hook portion of the hook screw 100 may be removed from the second disc 50. It is appreciated that the each of two ends of the main body 10 has an arcuate configuration 14, 18 that may prevent stress during manual rotational operation of the hook screw driver.

If the retaining section 54 on the second disc 50 does not have the proper pattern to securely retain the hook portion of the hook screw 100, the retaining section 53 on the second disc 50 (FIG. 7) is readily available when the second disc 50 is moved outside the main body 50. The user may simply turn the second disc 50 around to make the retaining section 53 face outside. In addition, the retaining sections 43 and 44 on the first disc 40 are also available when the first disc 40 is moved outside the main body 10 in a manner similar to the first disc 50 (FIG. 7). It is appreciated that the first and second discs 40 and 50 are made of plastic material, and the retaining blocks 431, 441, 531, and 541 are made of elastic material to securely hold the hook portion of the hook screw 100 without causing damage.

Figure 9:
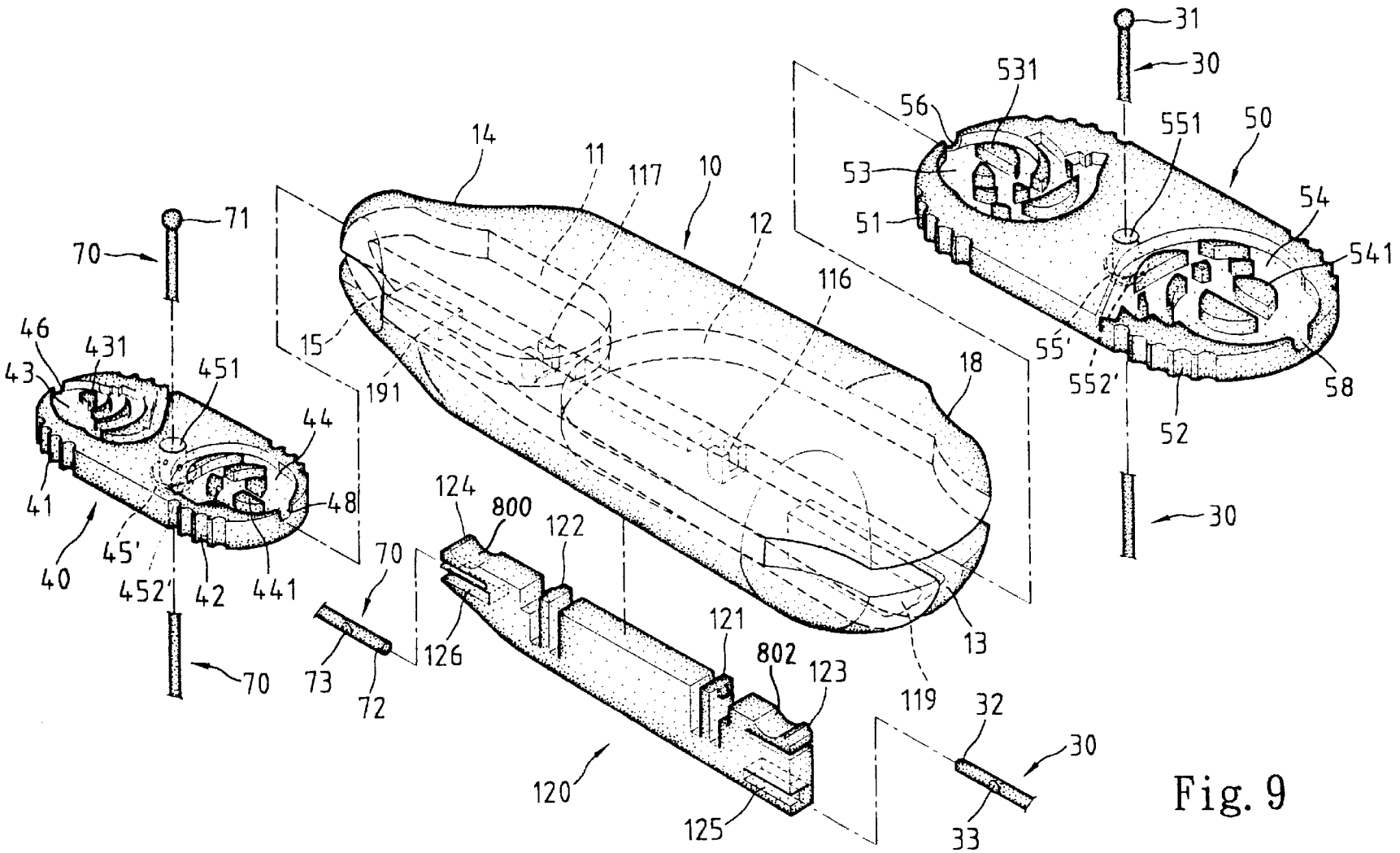
FIG. 9 is an exploded perspective view illustrating a second embodiment of the hook screw driver in accordance with the present invention.

FIG. 9 illustrates a second embodiment of the hook screw driver in accordance with the present invention. In this embodiment, the main body 10 includes two connecting blocks 191 and 119 respectively provided on two ends of the underside thereof. Each connecting block 191, 119 defines a portion of an associated track 15, 13 that is communicated with an associated compartment 11, 12 defined in the main body 10. Arrangements of the tracks 15 and 13 as well as the compartments 11 and 12 are identical to those disclosed in the first embodiment. A retaining means 120 is securely attached to the underside of the main body 10. In this embodiment, the retaining means 120 includes two hook fasteners 121 and 122 for respectively engaging with U-shaped members 116 and 117 provided on the underside of the main body 10. In addition, the retaining means 120 includes a retaining receptacle 125, 126 defined in each end thereof. Each end of the retaining means 120 further includes a stop 123, 124 formed thereon, which will be described later.

The second embodiment also includes a first disc 40 and a second disc 50 respectively, removably mounted in the first compartment 11 and the second compartment 12. Referring to FIGS. 9 and 10, the first disc 40 includes a guiding pin 45° formed on an underside thereof and slidable along the track 15. The first disc 40 further includes a recess 451 defined in an upper side thereof. In this embodiment, the guiding pin 45° includes a slot 452° communicated with the recess 451. Similarly, the second disc 50 includes a guiding pin 55° formed on an underside thereof and slidably along the track 13. The second disc 50 further includes a recess 551 defined in an upper side thereof. In this embodiment, the guiding pin 55° includes a slot 552° communicated with the recess 551 (FIG. 11). As shown in FIGS. 10 and 11, an inner periphery that defines the recess 451, 551 includes two protrusions 454, 554 formed thereon, which will be described later.

Like the first embodiment, the first disc 40 includes a first retaining section 43 and a second retaining section 44 formed on an upper side thereof, while the second disc 50 includes a third retaining section 53 and a fourth retaining section 54 formed on an upper side thereof. The first retaining section 43, the second retaining section 44, the third retaining section 53, and the fourth retaining section 54 respectively have a first pattern, a second pattern, a third pattern, and a fourth pattern formed thereon and different from one another. Each of the first pattern, the second pattern, the third pattern, and the fourth pattern is constructed by a plurality of spaced blocks 431, 441, 531, 541 that constitute a plurality of grooves adapted to securely retain a hook portion of a hook screw 100 (see FIG. 7 for reference) the size of which may vary in a wide range. Again, each pattern is a combination of several pattern elements such that the hook screw driver of the present invention may be applied to hook screws of numerous sizes as each of the first, second, third, and fourth retaining sections 43, 44, 53, and 53 may be applied to hook screws of various sizes in different ranges. Each disc 40, 50 includes two notches 46 and 48; 56 and 58 formed on two ends thereof which allow a stem portion of the hook screw 100 to extend therethrough (FIG. 7). Each end of the first disc 40 may include a grasp section 41, 42 formed on an outer periphery thereof to allow easy grasp. Similarly, each end of the second disc 50 may include a grasp section 51, 52 formed on an outer periphery thereof to allow easy grasp. The second embodiment also include two strings 70 and 30 each having a ball attached to an end thereof.

Figure 13:
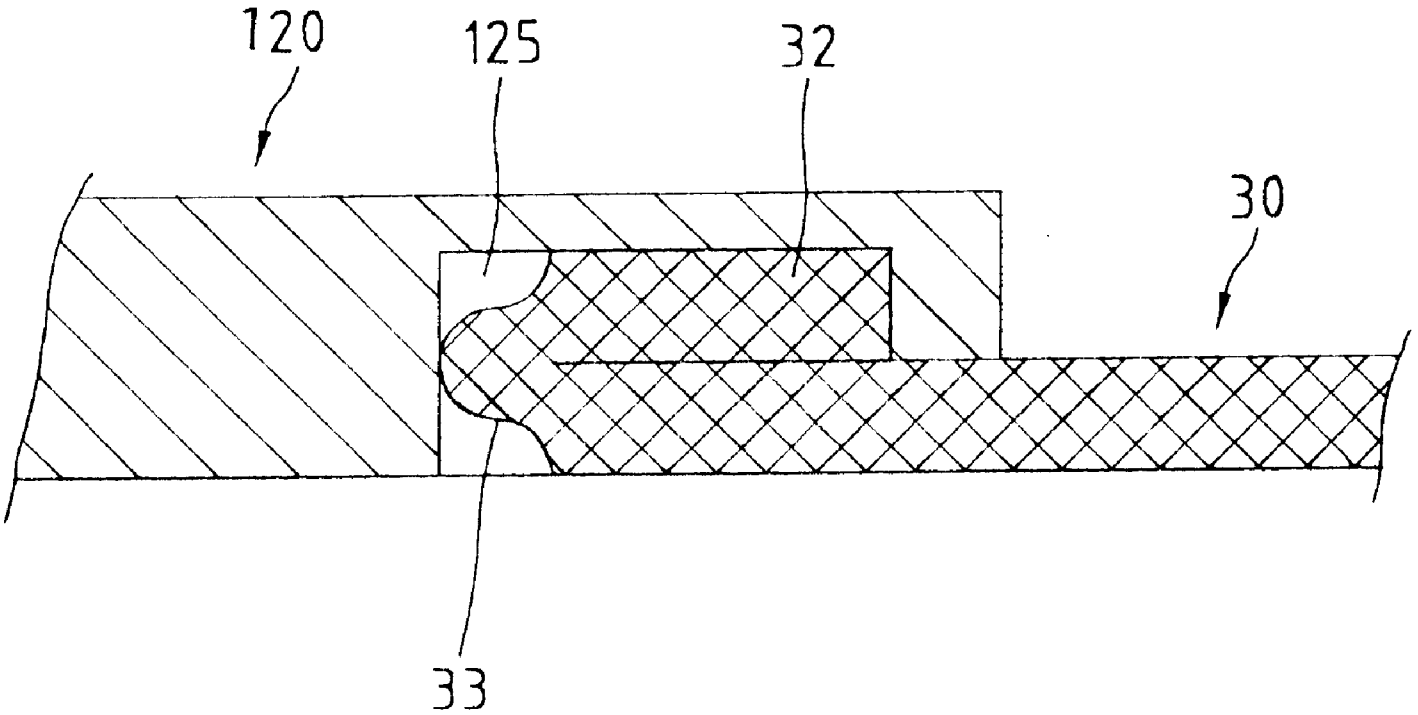
FIG. 13 is an enlarged partial sectional view illustrating engagement of a string and a retaining means of the hook screw driver in FIG. 10.

In assembly, the ball 71, 31 on each string 70, 30 is inserted into in the recess 451, 551 (FIGS. 10 and 12) and then forcibly passed through the associated protrusions 454, 554 and entered into the guiding pin 45, 55' of the associated disc 40, 50. Each string 70, 30 is then extended through the slot 452', 552' with the other end 72, 32 thereof securely attached to the retaining receptacle 126, 125. As shown in FIG. 13, each retaining receptacle 126, 125 is substantially U-shaped, while the other end 72, 32 of each string 70, 30 includes a hole 73, 33 (FIG. 9) to allow easy insertion into the retaining receptacle 126, 125 of the retaining means 120 which is securely attached to the underside of the main body 10 by means of engaging the hook fasteners 121 and 122 with the U-shaped members 116 and 117 (FIG. 10). Each disc 40, 50 is slid into the associated compartment 11, 12 via the associated track 15, 13. The guiding pin 45', 55' of the disc 40, 50 is received in an associated recessed section 800, 802 defined in the associated stop 124, 123 to retain the disc 40, 50 in position, yet, the disc 40, 50 still can be removed by forcibly passing the guiding pin 45', 55' out of the associated stop 124, 123. However, the disc 40, 50 is still attached to the retaining means 120 via the string 70, 30 (see FIG. 6 for reference) to thereby prevent from inadvertent loss of the disc 40, 50.

Operation of the hook screw driver of the second embodiment is identical to that of the first embodiment and therefore not further described.

According to the above description, it is appreciated that the hook screw driver may be applied to the hook screws of numerous sizes and the operation thereof is simple.

Although the invention has been explained in relation to its preferred embodiment, it is to be understood that many other possible modifications and variations can be made without departing from the spirit and scope of the invention as hereinafter claimed.

What is claimed is:

1. A hook screw driver comprising:

a main body including at least one compartment defined therein;

a disc being slidably, removably received in said at least one compartment, said disc having a retaining section with a pattern formed thereon, the pattern being constructed by a plurality of spaced blocks that constitute a plurality of grooves adapted to securely retain a hook portion of a hook screw, the retaining section of the disc being movable between a first position outside the main body for receiving the hook portion of the hook screw and a second position in said at least one compartment of the main body for retaining the hook portion of the hook screw in position;

wherein the disc further includes a second retaining section formed thereon and having a second pattern other than the first-mentioned pattern and constructed by a plurality of spaced second blocks that constitute a plurality of second grooves.

2. The hook screw driver according to claim 1, wherein the main body includes a retaining means provided thereon, and further comprises a string having a first end securely attached to the disc and a second end securely attached to the retaining means.

3. The hook screw driver according to claim 2, wherein the disc includes a recess defined in an upper side thereof, and the first end of the string includes a ball securely attached thereto and received in the recess of the disc.

4. The hook screw driver according to claim 3, wherein the disc includes a guiding pin mounted to the underside thereof, while the main body includes a track defined in an underside thereof and communicated with said at least one compartment, the guiding pin is slidable along the track.

5. The hook screw driver according to claim 4, wherein the main body includes a hole defined in an underside thereof and communicated with the track and said at least one compartment, and the retaining means is securely received in the hole.

6. The hook screw driver according to claim 5, wherein the hole is communicated with the track via a neck to retain the guiding pin of the disc in the hole when the retaining section of the disc is in the second position, and the guiding pin is forcibly passable through the neck.

7. The hook screw driver according to claim 2, wherein the retaining means includes at least one hook fastener, and the main body includes a member for engaging with said at least one hook fastener.

8. The hook screw driver according to claim 7, wherein the disc includes a guiding pin mounted to the underside thereof, while the main body includes a track defined in an underside thereof and communicated with said at least one compartment, and the guiding pin is slidable along the track.

9. The hook screw driver according to claim 8, wherein said retaining means includes a stop formed on an end thereof, and the stop includes a recessed section to retain the guiding pin in position.

10. The hook screw driver according to claim 9, wherein the disc includes a recess defined in an upper side thereof, a periphery defining the recess includes two protrusions formed thereon, the first end of the string includes a ball securely attached thereto and received in the guiding pin via the recess of the disc, the guiding pin further includes a slot that communicates with the underside of the disc so as to allow the second end of the string to pass through the slot to the retaining means.

11. The hook screw driver according to claim 10, wherein the retaining means includes a receiving receptacle to securely receive the second end of the string.

12. A hook screw driver, comprising a main body including two compartments respectively defined in two ends thereof, a first disc and a second disc being slidably, removably received in the compartments, respectively, the first disc having a first retaining section and a second retaining section formed on an upper side thereof, the second disc having a third retaining section and a fourth retaining section formed on an upper side thereof, the first retaining section, the second retaining section, the third retaining section, and the fourth retaining section respectively having a first pattern, a second pattern, a third pattern, and a fourth pattern formed thereon and different from one another, each of the first pattern, the second pattern, the third pattern, and, the fourth pattern being constructed by a plurality of spaced blocks that constitute a plurality of grooves adapted to securely retain a hook portion of a hook screw, and each of the first retaining section, the second retaining section, the third retaining section, and the fourth retaining section being movable between a first position outside the main body for receiving the hook portion of the hook screw and a second position in an associated said compartment for retaining the hook portion of the hook screw in position.

13. The hook screw driver according to claim 12, wherein the main body further includes a retaining means provided thereon, and further comprises a first string having a first end securely attached to the first disc and a second end securely attached to the retaining means, and a second string having a first end securely attached to the second disc and a second end securely attached to the retaining means.

14. The hook screw driver according to claim 12, wherein each of the first disc and the second disc includes a guiding pin formed on an underside thereof, while the main body includes a first track and a second track defined in an underside thereof and respectively communicated with the compartments to allow slidable movement of the guiding pins along the first track and the second track, respectively.

15. The hook screw driver according to claim 14, wherein the main body includes two holes defined in an underside thereof and respectively communicated with the first track and the second track, the holes are also communicated with the compartments, respectively, and the retaining means includes two retaining members respectively, securely received in the holes.

16. The hook screw driver according to claim 15, wherein each of the first track and the second track is communicated with an associated said hole via a neck to retain an associated said the guiding pin in the associated hole, and each said guiding pin is forcibly passable through an associated said neck.

17. The hook screw driver according to claim 12, wherein the retaining means includes at least one hook fastener, and the main body includes a member for engaging with said at least one hook fastener.

18. The hook screw driver according to claim 17, wherein each of the first disc and the second disc includes a guiding pin mounted to the underside thereof, while the main body includes a first track and a second track defined in an underside thereof and communicated with said compartments, respectively to allow sliding movement of said guiding pins along the first track and the second track, respectively.

19. The hook screw driver according to claim 18, wherein said retaining means includes a stop formed on each of two ends thereof, each said stop includes a recessed section to retain an associated said guiding pin in position.

* * * * *